US009266666B2

(12) United States Patent
Yue et al.

(10) Patent No.: US 9,266,666 B2
(45) Date of Patent: Feb. 23, 2016

(54) PACKAGING DEVICE

(71) Applicant: Shenzhen China Star Optoelectronics Technology Co., Ltd., Shenzhen, Guangdong (CN)

(72) Inventors: Liang Yue, Shenzhen (CN); Shih Hsiang Chen, Shenzhen (CN)

(73) Assignee: SHENZHEN CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 223 days.

(21) Appl. No.: 14/001,872

(22) PCT Filed: Jun. 25, 2013

(86) PCT No.: PCT/CN2013/077881

§ 371 (c)(1),
(2) Date: Aug. 28, 2013

(87) PCT Pub. No.: WO2014/169523

PCT Pub. Date: Oct. 23, 2014

(65) Prior Publication Data

US 2014/0311935 A1 Oct. 23, 2014

(30) Foreign Application Priority Data

Apr. 19, 2013 (CN) ..... 2013 1 0138124

(51) Int. Cl.

| | |
|---|---|
| ***B65D 81/02*** | (2006.01) |
| ***B65D 85/48*** | (2006.01) |
| ***B65D 25/10*** | (2006.01) |

(52) U.S. Cl.
CPC ..... *B65D 85/48* (2013.01); *B65D 25/10* (2013.01)

(58) Field of Classification Search
CPC combination set(s) only.
See application file for complete search history.

(56) References Cited

U.S. PATENT DOCUMENTS

| | | | | |
|---|---|---|---|---|
| 8,107,230 | B2 * | 1/2012 | Lee et al. | 361/679.27 |
| 2013/0104504 | A1 * | 5/2013 | Hu | 53/467 |
| 2013/0284638 | A1 * | 10/2013 | Hsiao et al. | 206/722 |
| 2014/0131240 | A1 * | 5/2014 | Zhao et al. | 206/451 |
| 2014/0166522 | A1 * | 6/2014 | Kuo et al. | 206/454 |

* cited by examiner

*Primary Examiner* — Jacob K Ackun

(57) ABSTRACT

A packaging device is provided, comprising a box for accommodating object to be packaged. The packaging device further comprises a limiter located on the both sides of the inner surface of the box. The limiter includes a fixing department and a limiting department. The limiting department is connected to one side of the fixing department and extends in a direction that is far away from the fixing department. The length of the projection of the fixing department, which is projected on a vertical plane perpendicular to the limiting department, is larger than the thickness of the limiting department. The fixing department is clamped fixedly by the box, and the limiting department stretches into the box to clamp the object to be packaged. Implementing the present invention, the limiter can be prevented from sliding out and the damage to the packaged object can be avoided.

7 Claims, 8 Drawing Sheets

PACKAGING DEVICE

FIELD OF THE INVENTION

The present invention relates to the packaging technique, and more particularly to a packaging device for a liquid crystal panel.

BACKGROUND OF THE INVENTION

At present, the box made of form or plastic material is used for packaging the liquid crystal panel when transported. The liquid crystal panel is laid flat. The position of the liquid crystal panel is limited by a limiter in the box. As shown in FIG. 1, the liquid crystal panel generally includes a liquid crystal display (LCD), a printed circuit board (PCB) 7 adjacent to the edge of one side of the LCD, and a plurality of chips on film (COFs) 8 connected between the LCD and the PCB 7. The packaging device for the liquid crystal panel generally includes a box 1 with an inner space. The inner space is consisted of a first cavity 11 configured to accommodate the LCD, and a second cavity 12 configured to accommodate the PCB 7 and the plurality of COFs 8. A limiter 2 is mounted between the first cavity 11 and the second cavity 12. The limiter 2 stretches into a position between the LCD and the PCB 7, and resists against the edge of the side of the LCD facing the PCB 7. The box 1 further includes an accommodation groove 9 configured to accommodate part of the limiter 2. During the transportation, a stress may be applied upon the limiter 2 by the LCD. Since part of the limiter 2 is inserted into the box 1, the box 1 will further be pressed under the stress applied to the limiter 2. When the stress applied by the LCD is large enough, the box 1 will be partially deformed easily. Due to the absence of a securing structure between the plane limiter 2 and the box 1, the limiter 2 will slide out from the box 1 when the box 1 is partially deformed. In this case, the limiter 2 cannot hold the liquid crystal panel any more, and thus the liquid crystal panel will move in the box 1, which will cause the liquid crystal panel to be damaged.

SUMMARY OF THE INVENTION

Aiming at the drawbacks in the prior art that the limiter in the packaging device for the liquid crystal panel would slide out when it is exerted with large stress, the object of the present invention is to provide a packaging device, especially a packaging device for packaging a liquid crystal panel, which is capable of preventing the limiter from sliding out.

A packaging device for packaging a liquid crystal panel is provided. The liquid crystal panel comprises a LCD, a PCB adjacent to the edge of one side of the LCD, and a plurality of COFs connected between the LCD and the PCB. The packaging device comprises a box with an inner space that is consisted of a first cavity configured to accommodate the LCD and a second cavity configured to accommodate the PCB and the COFs. The packaging device further comprises a limiter located at two opposite sides of an inner surface of the box. The limiter includes a fixing portion and a limiting portion. The limiting portion is connected to one side of the fixing portion and extends in a direction that is far away from the fixing portion. The length of the projection of the fixing portion, which is projected on a vertical plane perpendicular to the limiting portion, is larger than the thickness of the limiting portion. The fixing portion is clamped in the box fixedly, and the limiting portion extends from the inner surface to a position between the LCD and the PCB to limit the LCD.

In above packaging device for packaging the liquid crystal panel, an accommodation groove is defined on the inner surface of the box to accommodate at least part of the limiter. An opening of the accommodation groove is located between the first cavity and the second cavity. The limiter stretches out from the accommodation groove into the position between the LCD and the PCB, and resists against the edge of the side of the LCD facing the PCB.

In above packaging device for packaging the liquid crystal panel, the limiting portion of the limiter is plane, and the fixing portion of the limiter includes two plane first fixing plates, the two first fixing plates are connected to a single end of the limiting portion, the two first fixing plates are located at two sides of the limiting portion respectively, and the angles between each first fixing plate and the limiting portion are the same, which are not less than 90°.

In above packaging device for packaging the liquid crystal panel, the accommodation groove includes two first grooves and a second groove. The second groove is configured to accommodate at least part of the limiting portion and each first slot is configured to accommodate the first fixing plate. The two first grooves are connected to a single end of the second groove, the two first grooves are located at two sides of the second groove respectively, and the angles between each first groove and the second groove are the same, which are not less than 90°.

In above packaging device for packaging the liquid crystal panel, the limiting portion is plane, and the fixing portion includes a second fixing plate, a third fixing plate and a forth fixing plate. The second fixing plate, the third fixing plate and the forth fixing plate are connected successively, and the second fixing plate and the third fixing plate are plane. One end of the second fixing plate is connected perpendicularly to one end of the limiting portion. The other end of the second fixing plate is connected perpendicularly to one end of the third fixing plate. The extending direction of the third fixing plate is parallel to the extending direction of the limiting portion. The other end of the third fixing plate is connected perpendicularly to the forth fixing plate.

In above packaging device for packaging the liquid crystal panel, the accommodation groove includes a third groove, a forth groove and a fifth groove, the third groove, forth groove and the fifth groove are connected successively. The third groove is configured to accommodate the forth fixing plate. The forth groove is configured to accommodate the third fixing plate. The fifth groove is flat and L-shaped and is provided with an opening at the side facing the LCD, and the fifth groove is configured to accommodate part of the limiting portion and the second fixing plate connected perpendicularly to one end of the limiting portion. One end of the forth groove is perpendicularly communicated with the third groove. The other end of the forth groove is perpendicularly communicated with one end of the fifth groove, and the extending direction of the forth groove is parallel to the extending direction of the limiting portion.

In above packaging device for packaging the liquid crystal panel, the third groove is a square hole, a V-shaped hole or a T-shaped hole.

In above packaging device for packaging the liquid crystal panel, the forth fixing plate is plane, V-shaped or T-shaped.

In above packaging device for packaging the liquid crystal panel, the limiter has a contacting surface, the limiting portion contacts the LCD through the contacting surface, and a cushion is set between the contacting surface and the LCD.

Another packaging device is further provided, comprising a box configured to accommodate object to be packaged. The packaging device further comprises a limiter located at two opposite sides of an inner surface of the box. The limiter includes a fixing portion and a limiting portion. The limiting portion is connected to one side of the fixing portion and extends in a direction that is far away from the fixing portion. The length of a projection of the fixing portion, which is projected on a vertical plane perpendicular to the limiting portion, is larger than the thickness of the limiting portion. The fixing portion is clamped in the box fixedly, and the limiting portion extends to an interior of the box to clamp the object to be packaged.

In above packaging device, an accommodation groove is defined on the inner surface of the box to accommodate part of the limiter.

In above packaging device, the limiting portion of the limiter is plane, and the fixing portion of the limiter includes two plane first fixing plates. The two first fixing plates are connected to a single end of the limiting portion, the two first fixing plates are located at two sides of the limiting portion respectively, and the angles between each first fixing plate and the limiting portion are the same, which are not less than 90°.

In above packaging device, the accommodation groove includes two first grooves and a second groove. The second groove is configured to accommodate part of the limiting portion and each first groove is configured to accommodate the first fixing plate. The two first grooves are connected to a single end of the second groove, the two first grooves are located at two sides of the second groove respectively, and the angles between each first groove and the second groove are the same, which are not less than 90°.

In above packaging device, the limiting portion is plane, and the fixing portion includes a second fixing plate, a third fixing plate and a forth fixing plate. The second fixing plate, the third fixing plate and the forth fixing plate are connected successively, and the second fixing plate and the third fixing plate are plane. One end of the second fixing plate is connected perpendicularly to one end of the limiting portion. The other end of the second fixing plate is connected perpendicularly to one end of the third fixing plate. The extending direction of the third fixing plate is parallel to the extending direction of the limiting portion. The other end of the third fixing plate is connected perpendicularly to the forth fixing plate.

In above packaging device, the accommodation groove includes a third groove, a forth groove and a fifth groove, the third groove, forth groove and the fifth groove are connected successively. The third groove is configured to accommodate the forth fixing plate. The forth groove is configured to accommodate the third fixing plate. The fifth groove is flat and L-shaped and is provided with an opening at the side facing the LCD, and the fifth groove is configured to accommodate part of the limiting portion and the second fixing plate connected perpendicularly to one end of the limiting portion. One end of the forth groove is perpendicularly communicated with the third groove. The other end of the forth groove is perpendicularly communicated with one end of the fifth groove, and the extending direction of the forth groove is parallel to the extending direction of the limiting portion.

In above packaging device, the third groove is a square hole, a V-shaped hole or a T-shaped hole.

In above packaging device, the forth fixing plate is plane, V-shaped or T-shaped.

By implementing the present invention, the following advantages can be achieved. The structure of the limiter has been changed in the present invention to make sure that the limiter is secured in the box, and thus the limiter is prevented from sliding out from the box. The structure of the limiter has been changed and the box has been changed correspondingly, so forces in various directions will be applied to the box when the limiter is under the stress of the LCD, thus the probability of deforming the box is reduced. The limiter is hence prevented from sliding out from the box.

BRIEF DESCRIPTION OF THE DRAWINGS

The present invention is further illustrated in the following in combination with embodiments and the accompanying drawings, in which.

DETAILED DESCRIPTION OF THE PREFERRED EMBODIMENTS

A packaging device in the invention is mainly used for packaging the liquid crystal panel with a large size. The liquid crystal panel comprises a LCD, a PCB 7 and a plurality of COFs 8. The PCB 7 is adjacent to the edge of one side of the LCD. All of the COFs 8 are connected between the LCD and the PCB 7. Wherein, the plurality of COFs 8 may be spaced from each other.

Figure 1:
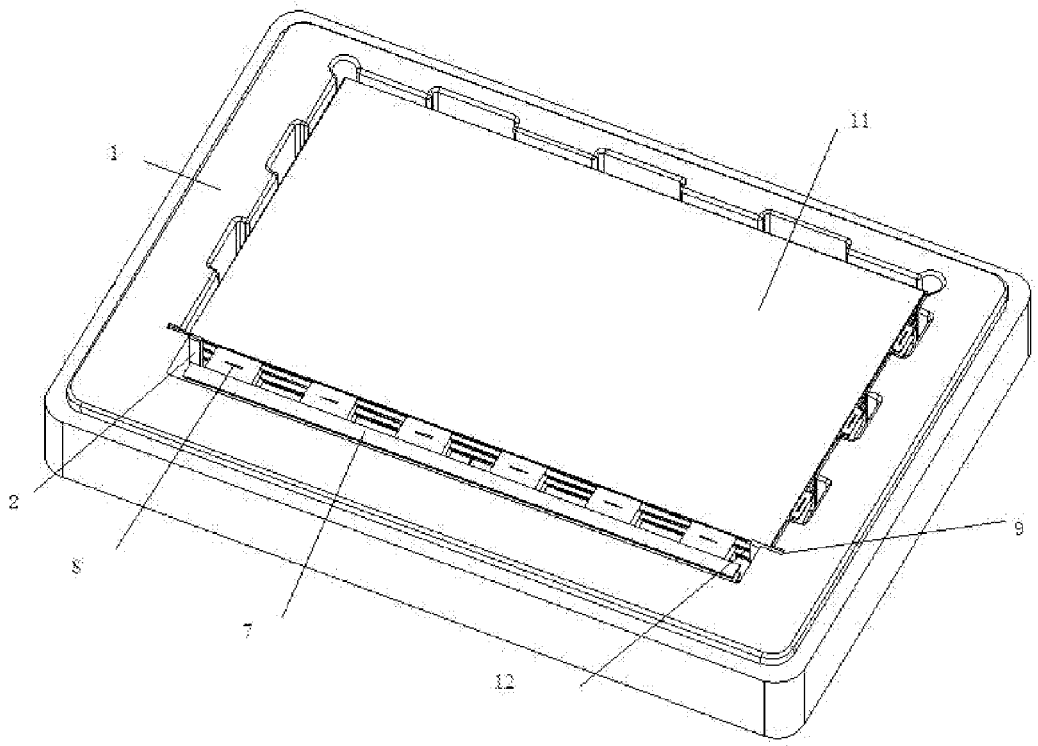
Fig. 1 (Prior Art)
FIG. 1 is a structure view of a packaging device for a liquid crystal panel in the prior art.
Figure 2:
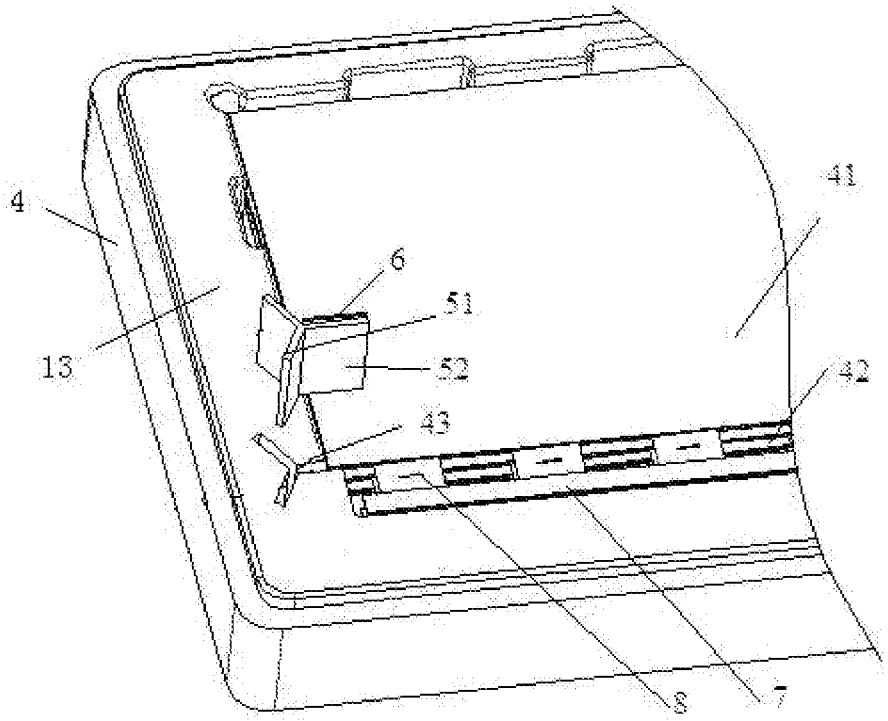
FIG. 2 is an exploded view of a packaging device for a liquid crystal panel according to a preferred embodiment of the present invention.
Figure 10:
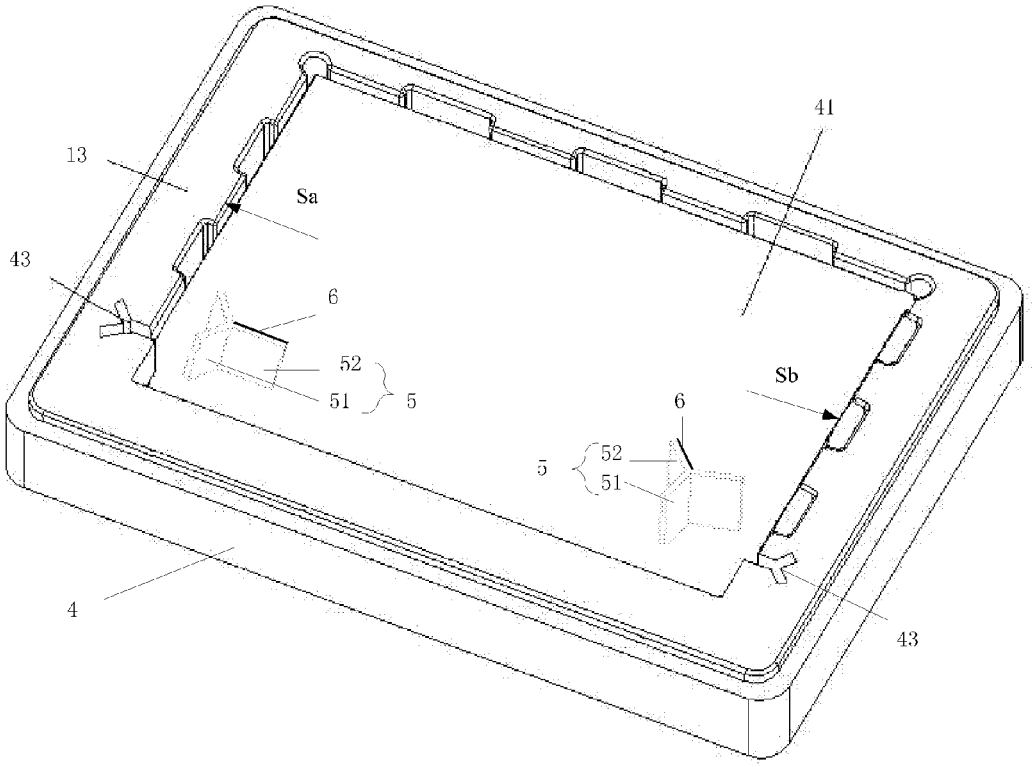
FIG. 10 shows an overall structure of the packaging device shown in FIG. 2.

FIG. 2 shows a packaging device for a liquid crystal panel according to a preferred embodiment. The packaging device for the liquid crystal panel includes a box 4 with an inner space. The inner space comprises a first cavity 41 configured to accommodate the LCD, and a second cavity 42 configured to accommodate the PCB 7 and the plurality of COFs. As shown in FIGS. 2 and 10, the packaging device further comprises a limiter 5 located at two opposite sides Sa and Sb of an inter surface 13 of the box 4. The limiter 5 includes a fixing portion 51 and a limiting portion 52. The limiting portion 52 is connected to one end of the fixing portion 51 and extends in a direction that is far away from the fixing portion 51. The length of a projection of the fixing portion 51, which is projected on a vertical plane perpendicular to the limiting portion 52, is larger than the thickness of the limiting portion 52. The fixing portion 51 is clamped in the box 4. The limiting portion 52 stretches out from the inner surface 13, and into a position between the LCD and the PCB 7 to limit the LCD.

An accommodation groove 43 is defined on the inner surface 13 of the box 4. The accommodation groove 43 is configured to accommodate part of the limiter 5. An opening of the accommodation groove 43 is located between the first cavity 41 and the second cavity 42. The limiting portion 52 stretches out from the accommodation groove 43, and into the position between the LCD and the PCB 7. The limiting portion 52 resists against the edge of the side of the LCD facing the PCB 7. In this case, when the limiter 5 is exerted with a force, the box 4 would exert a lot of reaction forces upon the limiter 5 to prevent the limiter 5 from sliding out and prevent the box 4 from being deformed partially.

The limiter 5 is made of hard material, such as cemented carbide, hard cotton, thermosetting material and the like. However, the hard material is not limited to above examples, and it can be selected according to actual requirements. The deformation of the limiter 5 under stress can be reduced when adopting the hard material.

Figure 3:
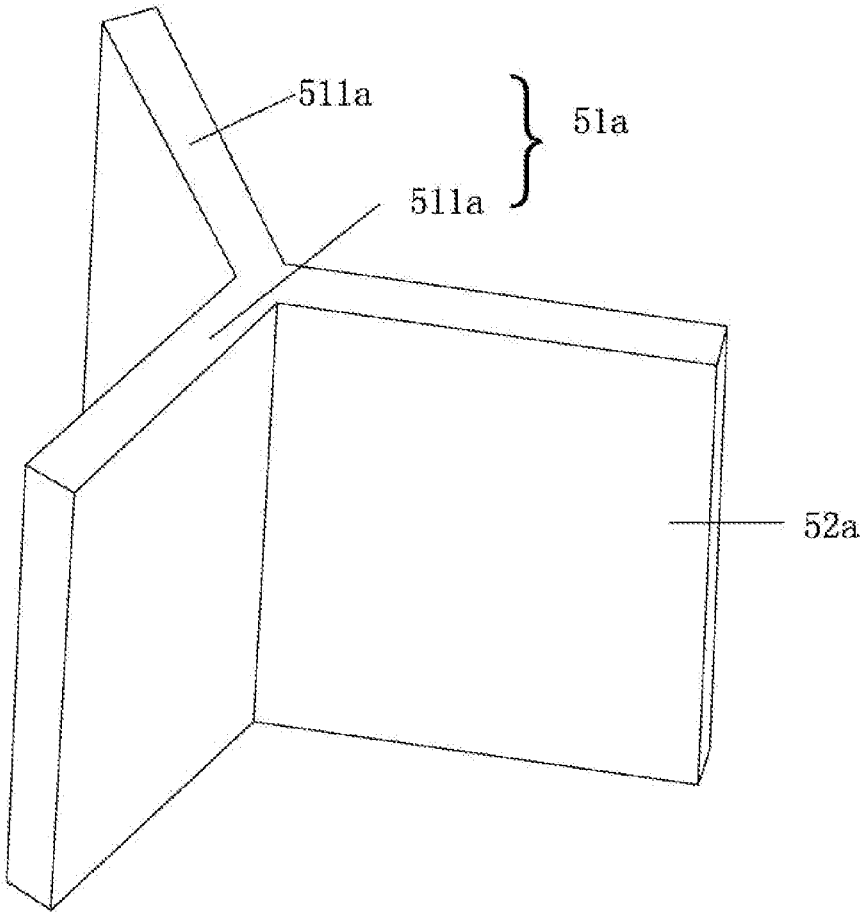
FIG. 3 is a structure view of a limiter according to a first preferred embodiment of the present invention.

FIG. 3 shows the limiter according to the first embodiment. The limiter 5 includes a limiting portion 52*a* and a fixing portion 51*a*. The limiting portion 52*a* is plane. In other embodiments, the limiting portion 52*a* may be a bent plate or a folded plate. The fixing portion 51*a* includes two plane first fixing plates 511*a*. The two first fixing plates 511*a* are connected to a single end of the limiting portion 52*a*, and the two first fixing plates 511*a* are located at two sides of the limiting portion 52*a* respectively, i.e. the limiting portion 52*a* extends in a direction that is far away from the fixing portion 51*a*. The angles between each first fixing plate 511*a* and the limiting portion 52*a* are the same, which are not less than 90°, preferably more than 90°. In this case, the limiting portion 52*a* and the two first fixing plates 511*a* together construct a Y-shaped structure. The thickness of the limiting portion 52*a* is less than the distance between two free ends of the two first fixing plates 511*a*, i.e. the length of a projection of the fixing portion 51*a*, which is projected on a vertical plane perpendicular to the limiting portion 52*a*, is larger than the thickness of the limiting portion 52*a*. In this case, the limiter 5 can be clamped more steadily to make sure that the limiter 5 is prevented from sliding out. Of course, the shape of the first fixing plate 511*a* is not limited to be plane, but may also be arcuate or curved.

Figure 4:
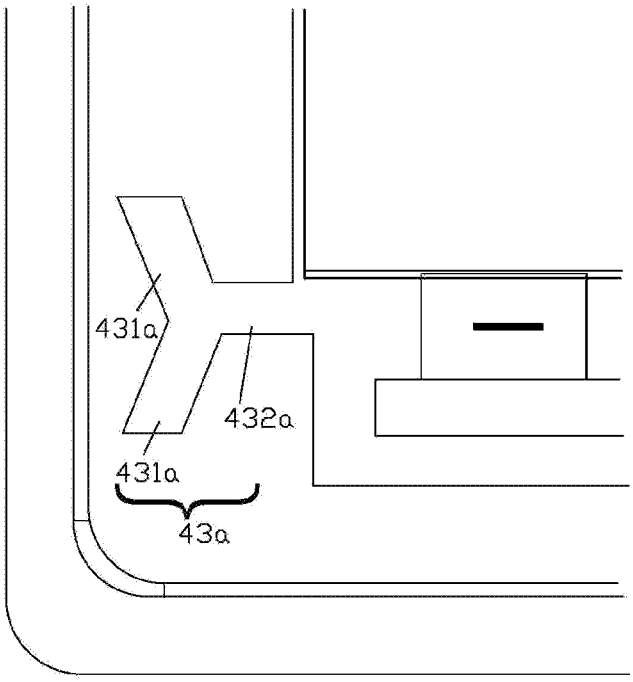
FIG. 4 is a structure view of an accommodation groove for the limiter shown in FIG. 3.

As shown in FIG. 4, the accommodation groove 43 corresponding to the limiter 5 in the first embodiment includes two first grooves 431*a* and a second groove 432*a*. The first grooves 431*a* and the second groove 432*a* are gap-shaped. The second groove 432*a* is configured to accommodate part of the limiting portion 52*a*, and the two first grooves 431*a* are configured to respectively accommodate the two first fixing plates 511*a*. The two first grooves 431*a* are connected to a single end of the second groove 432*a*, and the two first grooves 431*a* are located at two sides of the second groove 432*a* respectively. The angles between each first groove 431*a* and the second groove 432*a* are the same, which are not less than 90 degrees, preferably more than 90 degrees. In this case, the second groove 432*a* and the two first grooves 431*a* together construct a Y-shaped structure. An inner surface of each groove may be flat or uneven. The structure of each groove may be long-strip-shaped, zigzag-shaped, wave-shaped and the like, as long as the grooves can be engaged with the two first fixing plates 511*a*.

Figure 5:
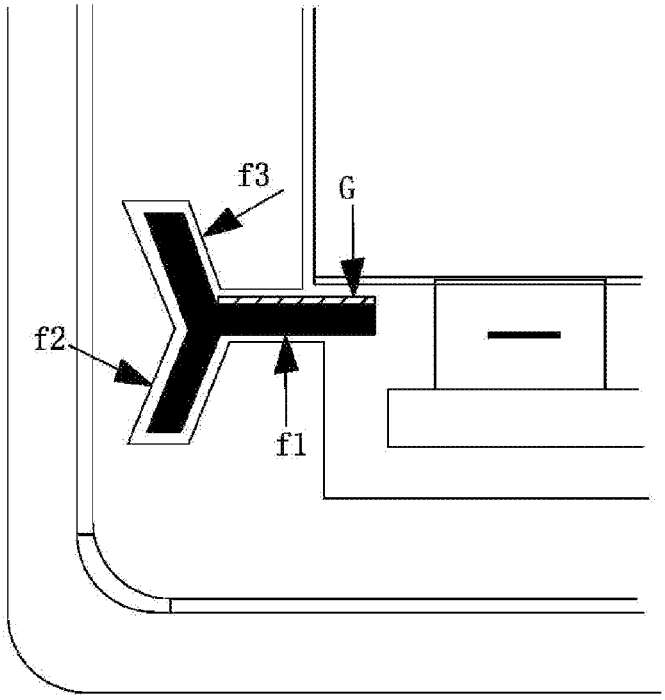
FIG. 5 shows forces on the limiter shown in FIG. 3.

As shown in FIG. 5, after the liquid crystal panel is packaged in the box 4, the wall of the accommodation groove 43 fits the limiter 5 closely. When the LCD exerts a stress G upon the limiter 5, the two first fixing plates 511*a* are exerted with reaction forces f2 and f3, and the limiting plate 52*a* is exerted with a holding force f1. According to the mechanical principles in physics, the stress G exerted upon the limiter 5 will be partially counteracted by the reaction forces f2 and f3. As a result, the holding force f1 is much less than the stress G. Accordingly, the stress applied to the box 4, which is a reaction force of the force f1, will be reduced. Thus, the probability for the box to be deformed or for the limiter to slide out will be reduced, which will hence reduce the probability for the LCD fixed by the limiter 5 to move around and hence reduce the probability for the COFs 8 to be broken.

Figure 6:
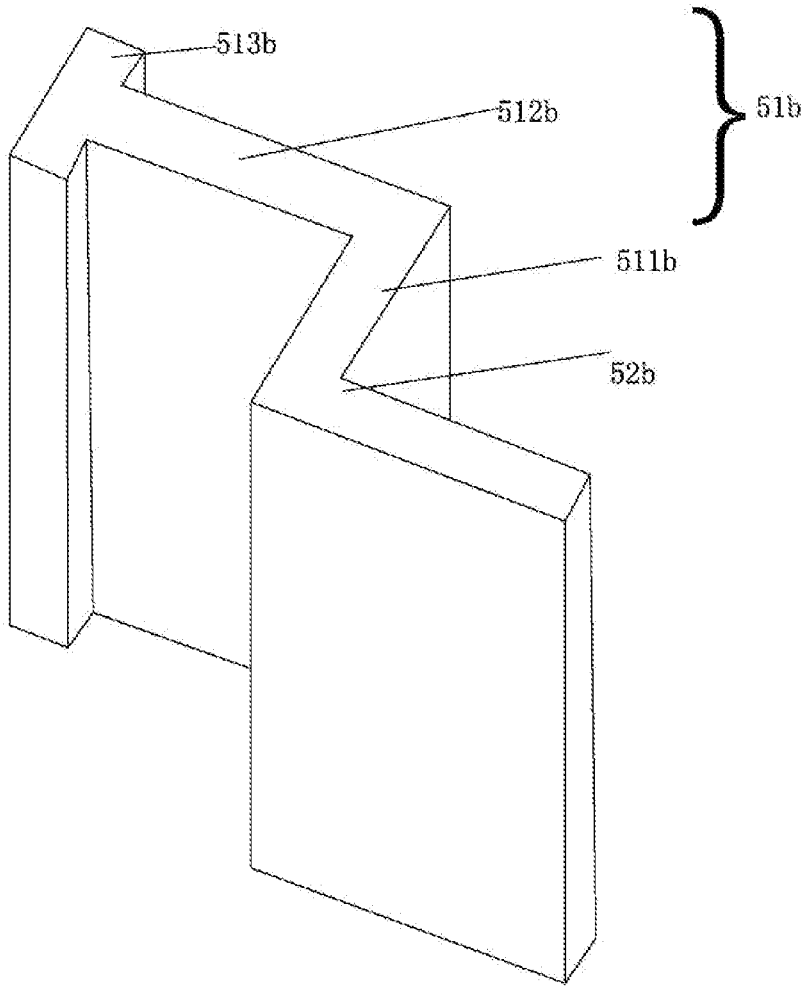
FIG. 6 is a structure view of a limiter according to a second preferred embodiment of the present invention.

FIG. 6 shows a structure view of the limiter 5 according to the second embodiment. As shown in FIG. 6, the limiter 5 includes a fixing portion 51*b* and a limiting portion 52*b*. In the embodiment, the limiting portion 52*b* is a plane plate. Of course, in other embodiments, the limiting portion 52*b* may be a bent plate or a folded plate. The fixing portion 51*b* includes a second fixing plate 511*b*, a third fixing plate 512*b* and a forth fixing plate 513*b*. The second fixing plate 511*b*, the third fixing plate 512*b* and the forth fixing plate 513*b* are connected successively, and each of them is plane. In other embodiments, each of the second fixing plate 511*b*, the third fixing plate 512*b* and the forth fixing plate 513*b* may be a bent plate or a folded plate. One end of the second fixing plate 511*b* is connected perpendicularly to one end of the limiting portion 52*b*. The other end of the second fixing plate 511*b* is connected perpendicularly to one end of the third fixing plate 513*b*. The extending direction of the third fixing plate 512*b* is parallel to the extending direction of limiting portion 52*b*. The other end of the third fixing plate 512*b* is connected perpendicularly to the middle of the forth fixing plate 513*b*. The forth fixing plate 513*b* is parallel to the second fixing plate 511*b*. The width of the forth fixing plate 513*b* is larger than the thickness of the limiting portion 52*b*. The length of the forth fixing plate 513*b* in a direction of the thickness of the limiting portion 52*b* is larger than the thickness of the limiting portion 52*b*. That is to say, the length of a projection of the fixing portion 51*b*, which is projected on a vertical plane perpendicular to the limiting portion 52*b*, is larger than the thickness of the limiting portion 52*b*. In this case, the limiter 5 can be clamped more steadily to make sure that the limiter 5 is prevented from sliding out.

Figure 7:
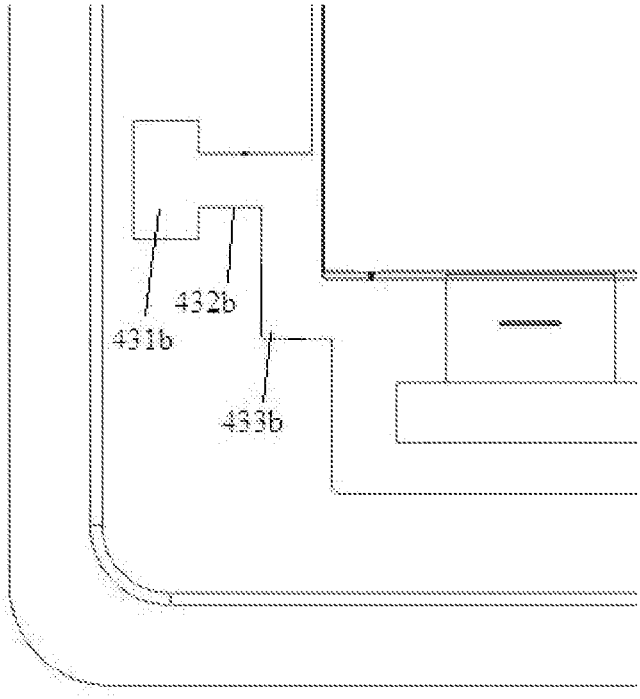
FIG. 7 is a structure view of an accommodation groove for the limiter shown in FIG. 6.

As shown in FIG. 7, the accommodation groove 43*b* corresponding to the limiter 5 according to the second embodiment includes a third groove 431*b*, a forth groove 432*b* and a fifth groove 433*b*. The third groove 431*b*, the forth groove 432*b* and the fifth groove 433*b* are connected successively. The third groove 431*b* is square-hole-shaped and configured to accommodate the forth fixing plate 513*b*. The forth groove 432*b* is gap-shaped and configured to accommodate the third fixing plate 512*b*. The fifth groove 433*b* is flat and L-shaped, and it has an opening facing to the LCD. The fifth groove 433*b* is configured to accommodate part of the limiting portion 52*b* and the second fixing plate 511*b* connected perpendicularly to one end of the limiting portion 52*b*. One end of the forth groove 432*b* is perpendicularly communicated with the middle of the third groove 431*b*. The other end of the forth groove 432*b* is perpendicularly communicated with one end of the fifth groove 433*b*. The extending direction of the forth groove 432*b* is parallel to the extending direction of the limiting portion 52*b*.

Figure 8:
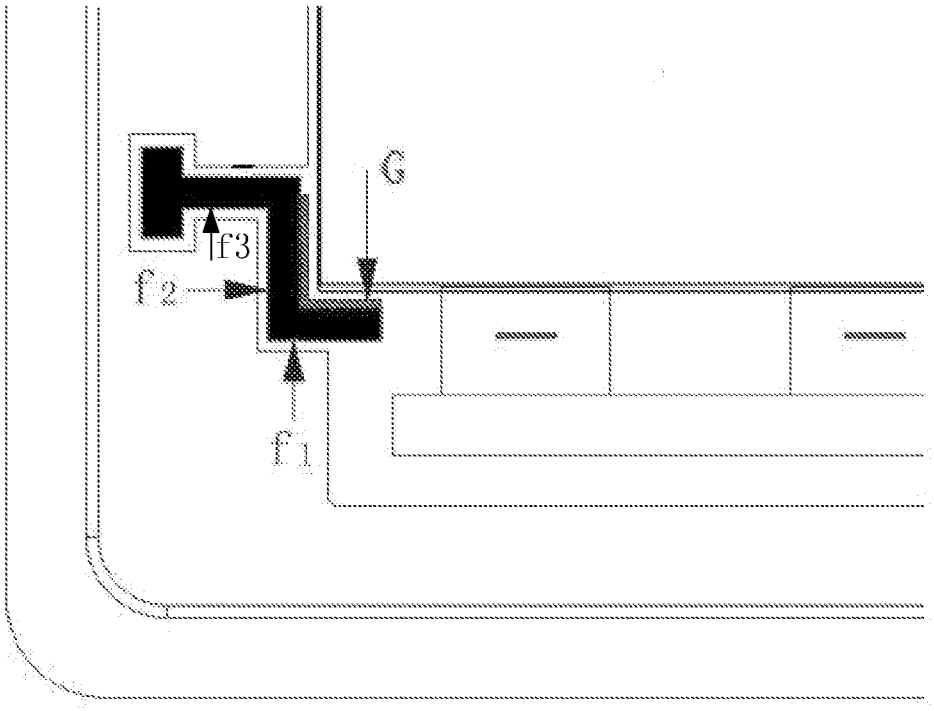
FIG. 8 shows forces on the limiter in FIG. 6.

As shown in FIG. 8, after the liquid crystal panel is packaged in the box 4, the wall of the accommodation groove 43 will fit the limiter 5 closely. When the LCD exerts a stress G upon the limiter 5, the fixing portion 51*b* of the limiter 5 is exerted with reaction forces f3, f1 and f2. According to mechanical principles in physics, the stress G exerted upon the limiter 5 would be partially counteracted by the reaction force f3. As a result, the reaction force f1 is much less than the stress G. Accordingly, the stress applied to the box 4, which is a reaction force of the force f1, will be reduced. Thus, the probability for the box to be deformed or for the limiter to slide out will be reduced, which will hence reduce the probability for the LCD to move around and hence reduce the probability for the COFs 8 to be broken.

In other embodiments, the forth fixing plate 513*b* may be designed to be plane, V-shaped or T-shaped, and thus a new structure of the limiter 5 is formed. Accordingly, the third groove may be designed to be square-hole, V-shaped or T-shape to accommodate the forth fixing plate 513*b*. According to mechanical principles in physics as mentioned above, when the LCD exerts a stress on the limiter 5, the limiter 5 will be exerted with more reaction forces, and thus the holding strength of the limiter 5 is increased and the limiter 5 is prevented from sliding out.

Referring to FIG. 2 to FIG. 8, the limiter 5 further includes a contacting surface (not labeled). The limiter 5 contacts the LCD through the contacting surface. In FIG. 3, the contacting surface is located on a plane the limiting portion 52*b*, facing the LCD. In FIG. 6, the contacting surface is located on planes of the second fixing plate 511*b* and the limiting portion 52*b*, facing the LCD. Preferably, the contacting surface is a flat surface to make the limiter 5 and the LCD fit more closely and to increase the contacting area. The contacting surface may also be an uneven surface to achieve the anti-skidding effect. The packaging device further comprises a cushion 6 located between the contacting surface and the LCD. Preferably, the cushion 6 is stuck to the contacting surface or directly placed on the contacting surface. Advantageously, the shape of the cushion 6 should match with the shape of the contacting surface, thus achieving a better buffering effect. Of course, in other embodiments, the cushion 6 may be designed to be other shapes. Advantageously, the cushion 6 is made of soft material such as sponge, rubber and the like.

Figure 9:
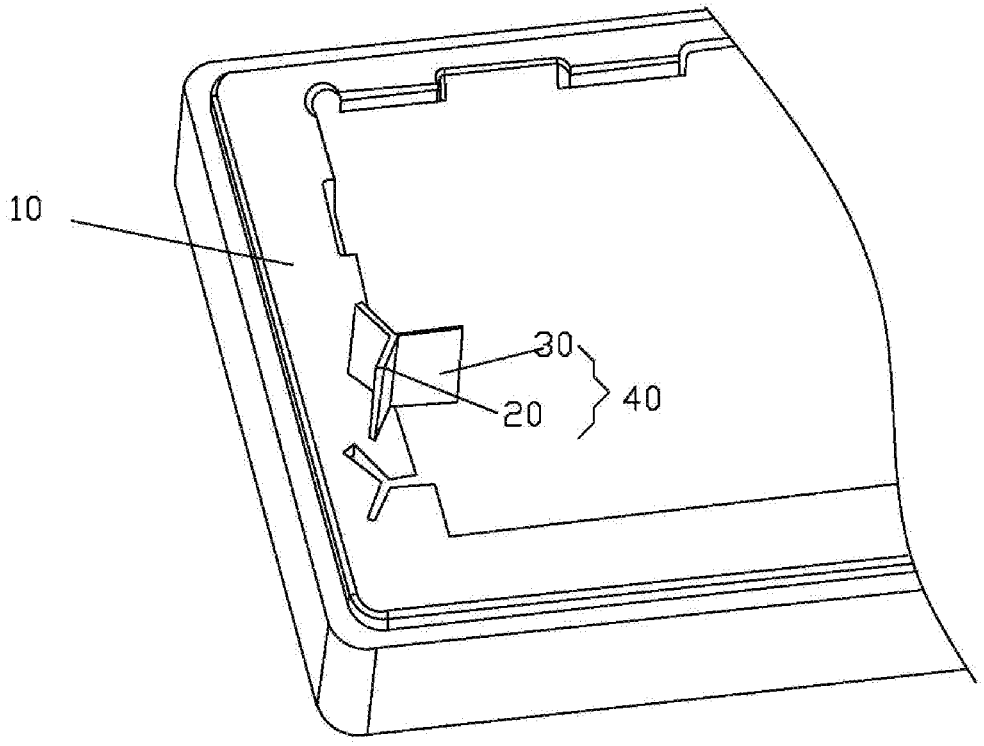
FIG. 9 is a structure view of a packaging device according to another preferred embodiment of the present invention.

As shown in FIG. 9, anther packaging device is further provided in the present invention. The packaging device includes a box 10 configured to accommodate object to be packaged, and a limiter 40 located at two opposite sides of an inter surface of the box 10. The limiter 40 includes a fixing portion 20 and a limiting portion 30. The limiting portion 30 is connected to one end of the fixing portion 20 and extends in a direction that is far away from the fixing portion 20. The length of a projection of the fixing portion 20, which is projected on a vertical plane perpendicular to the limiting portion 30, is larger than the thickness of the limiting portion 30. The fixing portion 20 is clamped fixedly in the box 10. The limiting portion 30 stretches into the box 10 to clamp the object to be packaged. The structure of the box 10 and limiter 40 are the same with that of the packaging device for the liquid crystal panel. However, the packaging device is not only for packaging the liquid crystal panel, but also for packaging other objects.

The invention claimed is:

1. A packaging device comprising a box with an inner surface, and a limiter located at two opposite sides of the inner surface;

wherein, the limiter includes a fixing portion and a limiting portion; the limiting portion is connected to one side of the fixing portion and extends in a direction that is away from the fixing portion;

the fixing portion comprises two first fixing plates, the limiting portion is a limiting plate, the two first fixing plates are both connected to a single end of the limiting plate, and the limiter is configured to be Y-shaped;

an accommodation groove is defined in the inner surface of the box and is configured to accommodate the fixing portion and part of the limiting portion; the limiting portion extends out of the accommodation groove to interior of the box.

2. The packaging device of claim 1, wherein, the limiting portion and the fixing portion are plane plates, the two first fixing plates are located at two sides of the limiting plate respectively, and an angle between one first fixing plate and the limiting plate is the same as that between the other first fixing plate and the limiting plate, which is not less than 90°.

3. The packaging device of claim 2, wherein, the accommodation groove includes two first grooves and a second groove;

the second groove is configured to accommodate part of the limiting plate and the two first grooves are respectively configured to accommodate the two first fixing plates;

the two first grooves are located at two sides of the second groove respectively, and an angle between one first groove and the second groove is the same as that between the other first groove and the second groove, which is not less than 90°.

4. A packaging device comprising a box with an inner surface, and a limiter located at two opposite sides of the inner surface;

wherein, the limiter includes a fixing portion and a limiting portion; the limiting portion is connected to one side of the fixing portion and extends in a direction that is away from the fixing portion;

the limiting portion is a limiting plate, and the fixing portion includes a second fixing plate, a third fixing plate and a fourth fixing plate;

the second fixing plate, the third fixing plate and the fourth fixing plate are connected successively, and the second fixing plate and the third fixing plate are plane plates;

one end of the second fixing plate is connected perpendicularly to one end of the limiting plate;

the other end of the second fixing plate is connected perpendicularly to one end of the third fixing plate;

the third fixing plate and the limiting plate extend from the second fixing plate in opposite directions respectively;

the other end of the third fixing plate is connected perpendicularly to the fourth fixing plate;

an accommodation groove is defined in the inner surface of the box and is configured to accommodate the fixing portion and part of the limiting portion; the limiting portion extends out of the accommodation groove to interior of the box.

5. The packaging device of claim 4, wherein, the accommodation groove includes a third groove, a fourth groove and a fifth groove, and the third groove, fourth groove and the fifth groove are connected successively;

the third groove is configured to accommodate the fourth fixing plate; the fourth groove is configured to accommodate the third fixing plate; the fifth groove is flat and L-shaped and is provided with an opening, and the fifth groove is configured to accommodate the second fixing plate and the limiting plate; the limiting plate extends out of the fifth groove via the opening to interior of the box;

one end of the fourth groove is perpendicularly communicated with the third groove; the other end of the fourth groove is perpendicularly communicated with one end of the fifth groove, and the extending direction of the fourth groove is parallel to the extending direction of the limiting plate.

6. The packaging device of claim 5, wherein, the third groove is V-shaped or T-shaped.

7. The packaging device of claim 6, wherein, the fourth fixing plate is plane, V-shaped or T-shaped.

* * * * *